US009832573B2

(12) United States Patent
Hall et al.

(10) Patent No.: US 9,832,573 B2
(45) Date of Patent: Nov. 28, 2017

(54) ENTRAINED MICROPHONES

(71) Applicant: Silicon Audio Directional, LLC, Austin, TX (US)

(72) Inventors: Neal A. Hall, Austin, TX (US); Caesar T. Garcia, Austin, TX (US); Bradley D. Avenson, Austin, TX (US); Abidin Guclu Onaran, Austin, TX (US)

(73) Assignee: Silicon Audio Directional, LLC, Austin, TX (US)

( * ) Notice: Subject to any disclaimer, the term of this patent is extended or adjusted under 35 U.S.C. 154(b) by 0 days.

(21) Appl. No.: 15/182,233

(22) Filed: Jun. 14, 2016

(65) Prior Publication Data

US 2016/0295333 A1 Oct. 6, 2016

Related U.S. Application Data

(62) Division of application No. 14/194,328, filed on Feb. 28, 2014, now abandoned.

(Continued)

(51) Int. Cl.

| | |
|---|---|
| ***H04R 25/00*** | (2006.01) |
| ***H04R 17/02*** | (2006.01) |
| ***H04R 19/01*** | (2006.01) |
| ***H04R 19/04*** | (2006.01) |
| ***H04R 1/04*** | (2006.01) |

(Continued)

(52) U.S. Cl.

CPC ..... *H04R 17/02* (2013.01); *H04R 1/04* (2013.01); *H04R 1/342* (2013.01); *H04R 19/016* (2013.01); *H04R 19/04* (2013.01); *H04R 23/006* (2013.01); *H04R 2201/003* (2013.01); *H04R 2499/11* (2013.01)

(58) Field of Classification Search

CPC . H04R 1/04; H04R 1/342; H04R 7/16; H04R 17/005; H04R 17/02; H04R 19/016; H04R 19/04; H04R 23/006; H04R 31/003; H04R 2201/003; H04R 2217/01

USPC ... 381/91, 92, 114, 355, 356, 357, 360, 361, 381/173, 174, 190, 191

See application file for complete search history.

(56) References Cited

U.S. PATENT DOCUMENTS

| | | | |
|---|---|---|---|
| 5,870,482 | A | 2/1999 | Loeppert |
| 6,243,474 | B1 | 6/2001 | Tai |

(Continued)

OTHER PUBLICATIONS

Royer, M.; J.O. Holmen; M.A. Wurm; O.S. Aadland; and M. Glenn; "ZnO on Si Integrated Acoustic Sensor"—Sensors and Actuators, vol. 4, pp. 357-362, May 1983; Delft, The Neterlands (6 pages).

(Continued)

*Primary Examiner* — Huyen D Le

(74) *Attorney, Agent, or Firm* — Meyertons Hood Kivlin Kowert & Goetzel, P.C.; Jeffrey C. Hood; Brian E. Moore

(57) ABSTRACT

In some embodiments, a microphone system may include a deformable element that may be made of a material that is subject to deformation in response to external phenomenon. Sensing ports may be in contact with a respective region of the deformable element and may be configured to sense a deformation of a region of the deformable element and generate a signal in response thereto. The plurality of signals may be useable to determine spatial dependencies of the external phenomenon. The external phenomenon may be pressure and the signals may be useable to determine spatial dependencies of the pressure.

18 Claims, 13 Drawing Sheets

Related U.S. Application Data

(60) Provisional application No. 61/771,286, filed on Mar. 1, 2013.

(51) Int. Cl.
*H04R 23/00* (2006.01)
*H04R 1/34* (2006.01)

(56) References Cited

U.S. PATENT DOCUMENTS

| | | | | |
|---|---|---|---|---|
| 6,535,460 | B2 | 3/2003 | Loeppert | |
| 7,301,212 | B1 | 11/2007 | Mian | |
| 2006/0093170 | A1* | 5/2006 | Zhe | H04R 31/003 381/191 |
| 2010/0158279 | A1 | 6/2010 | Conti | |
| 2011/0227177 | A1 | 9/2011 | Nakatani | |
| 2012/0250897 | A1 | 10/2012 | Michel | |
| 2013/0129136 | A1 | 5/2013 | Harney | |

OTHER PUBLICATIONS

Kim, Eun Sok and Richard S. Muller; "IC-Processed Piezoelectric Microphone" IEEE Electron Device Letters, vol. EDL-8, No. 10, pp. 467-468; Oct. 1987 (2 pages).

Lee, Seung S.; Robert P. Ried; and Richard M. White; "Piezoelectric Cantilever Microphone and Microspeaker"—Journal of Microelectromechanical Systems, vol. 5, No. 4, pp. 238-242; Dec. 1996 (5 pages).

Williams, Matthew D. et al. "An AIN MEMS Piezoelectric Microphone for Aeroacoustic Applications" Journal of Microelectromechanical Systems, vol. 21, No. 2, Apr. 2012, pp. 270-283 (14 pages).

Fazzio, R. Shane et al. "Design and Performance of Aluminum Nitride Piezoelectric Microphones" The 15th International Conference on Solid-State Sensors, Actuators and Microsystems, Jun. 10-14, 2007; pp. 1255-1258; Lyon, France (4 pages).

Saleh, Sherif A. et al. "Design of Piezoelectric Cantilever Microphone and Its MEMS-Acoustical Circuit for Hearing Aid Devices" IEEE 46th Midwest Symposium on Circuits and Systems, Dec. 27-30, 2003; pp. 897-900, vol. 2 (4 pages).

Zhao, Hong-Jin et al. "Fabrication of High-Quality PZT-Based Piezoelectric Microphone" The 12th International Conference on Solid State Senors, Actuators and Microsystems, Jun. 8-12, 2003; pp. 234-237; vol. 1; Boston, Massachusetts, USA (4 pages).

Horowitz, Stephen et al. "Development of a Micromachined Piezoelectric Microphone for Aeroacoustics Applications" Journal of Acoustical Society of America; Dec. 2007, pp. 3428-3436, vol. 122, No. 6 (9 pages).

Medill, John—"A Miniature Piezoelectric Microphone" Journal of Acoustical Society of America, Sep. 1953, pp. 864-866, vol. 25, No. 5 (3 pages).

Dehe, Alfons—"Silicon Microphone Development and Application" Sensors and Actuators A: Physical; vol. 133, Issue 2, pp. 283-287, Feb. 12, 2007 (5 pages).

* cited by examiner

ENTRAINED MICROPHONES

PRIORITY DATA

This application is a divisional application of U.S. patent application Ser. No. 14/194,328, title "Entrained Microphones", filed Feb. 28, 2014, whose inventors were Neal A. Hall, Caesar T. Garcia, Bradley D. Avenson, and Abidin Guclu Onaran, and which claims benefit of priority to U.S. Provisional Application Ser. No. 61/771,286, titled "Directional Microphones", filed Mar. 1, 2013, whose inventors were Bradley D. Avenson, Caesar T. Garcia, Neal A. Hall, and Abidin Guclu Onaran, each of which is hereby incorporated by reference in its entirety as though fully and completely set forth herein.

FIELD OF THE INVENTION

This disclosure relates generally to microphones, and more particularly to directional microphones for use in, for example, cellular telephones and hearing aids.

DESCRIPTION OF THE RELATED ART

Miniature microphones, which may be used in a variety of applications (e.g., defense, cellular telephones, laptop computers, portable consumer electronics, hearing aids), generally include a compliant membrane and a rigid back electrode in close proximity to form a capacitor with a gap. Incoming sound waves induce vibrations in the compliant membrane and these vibrations change the capacitance of the structure which can be sensed with electronics.

Recently, micro-electro-mechanical systems (MEMS) processing has been utilized to fabricate miniature microphones. Additionally, piezoelectric microphones with in-plane (i.e., x-y plane) directivity were recently introduced. These structures synthesized an innovative biologically-inspired sensing structure with integrated piezoelectric readout. It is reasoned that A-weighted pressure noise levels approaching 40 dB(A) are achievable from a structure that can be repeated on chip to address both in-plane gradient measurements (i.e., $\partial P/\partial x$, $\partial P/\partial y$). Preliminary directivity measurements illustrated proof-of-concept functionality. However, further improvements in the field are desired.

SUMMARY OF THE INVENTION

Various embodiments of a directional microphone are presented herein. The directional microphone may comprise a microphone (e.g., piezoelectric) with in-plane and out-of-plane directivity (i.e., a $\partial P/\partial z$ acoustic sensor).

In one embodiment a sensor system may comprise a deformable element and a plurality of sensing ports. In certain embodiments, the sensor system may be a microphone system. The plurality of sensing ports may be a plurality of piezoelectric sensing ports. In one embodiment, in response to air pressure acting upon the deformable element, the plurality of sensing ports may be configured to generate a plurality of signals in response thereto. Each sensing port may be configured to sense a deformation of a corresponding respective region of the deformable element and generate a corresponding respective signal in response thereto. In other words, each sensing port may be responsive to deformation of a corresponding respective region of the deformable element. The plurality of signals together may collectively provide an indication of changes to the deformable element.

In certain embodiments, the deformable element may be configured to deform responsive to external phenomenon. In one embodiment the external phenomenon may be pressure or sound pressure. In such embodiments, the changes to the deformable element may be in response to the sound pressure, or derivatives of such changes. Thus the plurality of signals may provide an indication of spatial derivatives of the changes, such as pressure gradients, e.g., spatial changes in deformation along a predetermined spatial region or axis. Thus the spatial derivatives of the changes may comprise first, second or higher derivatives of pressure along a spatial domain.

Further, in some embodiments, the signals may be useable to determine spatial dependencies of the external phenomenon. Thus, in embodiments where the external phenomenon may be pressure, the signals may be usable to determine spatial dependencies of the pressure.

In one embodiment, the sensor system may further include a container having at least one opening on at least one side. The container may enclose the deformable element and the plurality of sensing ports. Further, in certain embodiments, the container may include a first opening on a first side and a second opening on a second side. The second side may be approximately opposite the first side and the container may enclose the deformable element and the plurality of sensing ports. In one embodiment, the deformable element may have a fundamental resonant frequency below an audio spectrum or near a center of the audio spectrum.

In more specific embodiments, a microphone device may include a directional microphone including a container. The container may include a first opening in a first side of the container. The container may include a second opening in a second side of the container. The second side may be substantially, or approximately, opposite the first side. The container may include a sensing element positioned in the container. The sensing element may include a diaphragm coupled to at least one elongated member. The sensing element may sense, during use, sound energy. The sensing element may be coupled to the container using the at least one elongated member. In some embodiments, the diaphragm may include a plurality of openings extending through the diaphragm. At least some of the plurality of openings may be sized such that gases are inhibited, during use, from being conveyed through the plurality of openings. In one embodiment, a coating may cover at least a portion of the plurality of openings such that gases may be inhibited from conveying through the covered openings.

In some embodiments, the elongated member may be configured to limit the directional microphone's resonant frequency below an audio spectrum or near a center of the audio spectrum. In one embodiment, the resonant frequency may be less than approximately 100 hertz. In another embodiment, the center of the audio spectrum may be approximately 1,000 hertz.

In certain embodiments, the device may further include at least one piezoelectric sensing apparatus coupled to the elongated member. In an exemplary embodiment, the elongated member may be cantilevered.

In various embodiments the diaphragm may be approximately circular or approximately square. In certain embodiments, the sensing element may be oriented out of plane relative to the sound energy detected by the sensing element. In one embodiment, the sensing element may move in response to sound energy entering at least the first opening. In certain embodiments, the sensing element may include graphene.

In an exemplary embodiment, the sound energy may be obtained by measuring an open-circuit voltage generated by movement of the sensing element and the open-circuit voltage may be directly proportional to a displacement of the sensing element. Alternatively, in another embodiment, the sound energy may be obtained by measuring a short-circuit charge generated by movement of the sensing element and the short-circuit charge may be directly proportional to a displacement of the sensing element. In yet another embodiment, the sound energy may be obtained by measuring a short circuit current generated by movement of the sensing element and the short circuit current may be directly proportional to a velocity of the sensing element. In certain embodiments, the short circuit current may be measured using a trans-impedance amplifier.

In some embodiments, the device may further include at least a first cover that may cover at least a portion of the first opening such that bulk air flow may be inhibited from moving the sensing element. In other embodiments the device may further include a first cover that may cover at least a portion of the first opening and a second cover that may cover at least a portion of the second opening such that bulk air flow may be inhibited from moving the sensing element.

In certain embodiments, the device may further include at least a second sensing element positioned in the container. In some embodiments, the sensing element and the at least second sensing element are approximately aligned along a z-axis.

In an exemplary embodiment, the directional microphone may be formed as a part of a user equipment or as part of a hearing aid.

In another embodiment, a microphone device may include a directional microphone that may have a container. The container may include a first opening in a first side of the container and a sensing element positioned in the container. The sensing element may be configured to sense sound energy during use. Additionally, the sensing element may include a plurality of openings extending through the sensing element and at least some of the plurality of openings may be sized such that gases are inhibited, during use, from being conveyed through the plurality of openings. Further, the sensing element may be coupled to the container using an elongated member.

In certain embodiments, the device may also include a second opening in a second side of the container and the second side may be approximately opposite the first side. In some embodiments, the device may include a coating that may cover at least a portion of the plurality of openings such that gases may be inhibited from conveying through the covered openings.

In an embodiment, a device may include a directional microphone that may include a container. The container may include a first opening in a first side of the container and a sensing element positioned in the container. The sensing element may be configured to sense sound energy during use and may be coupled to the container using a cantilevered elongated member that may be configured to limit the directional microphone's resonant frequency below an audio spectrum or near a center of the audio spectrum. In one embodiment, the audio spectrum may be less than approximately 100 hertz. In another embodiment, the audio spectrum may be less than approximately 1,000 hertz.

In one embodiment, a method for fabricating a directional microphone may include thermally oxidizing a first layer and depositing a second layer on a first side of the first layer. Additionally, a third layer may be deposited on a second side of the first layer. One or more first electrodes may be disposed on the third layer. In some embodiments, disposing the one or more first electrodes may include patterning one or more first locations of the one or more first electrodes and sputtering a conductive layer at the one or more locations. The method may also include depositing one or more piezoelectric layers on the third layer and the one or more first electrodes. Further, one or more second electrodes may be disposed on the one or more piezoelectric layers. In certain embodiment this may include patterning one or more second locations of the one or more second electrodes and sputtering a conductive layer at the one or more locations. The first, second, third and one or more piezoelectric layers may be etched and a diaphragm, or sensing element, and a spring and piezoelectric sensing structure may be formed.

In yet another embodiment a system may include a deformable element. The deformable element may include a plurality of sensing ports. The plurality of sensing ports may be configured to generate a plurality of signals and each sensing port of the one or more sensing ports may be configured to sense a deformation of a corresponding respective region of the deformable element and generate a corresponding respective signal of the plurality of signals, responsive to the deformation of the corresponding respective region of the deformable element. The plurality of signals together may provide an indication of a characteristic of an effect acting on the deformable element and spatial derivatives of the characteristic of the effect.

In certain embodiments, the deformable element may be configured to deform under sound pressure. In such embodiments, the effect may be sound and the characteristic may be pressure. Additionally, some embodiments, the plurality of sensing ports may be a plurality of piezoelectric sensing ports.

In one embodiment, the system may further include a container and the container may include a first opening on a first and a second opening on a second side. Note that the second side may be approximately opposite the first side and the container may enclose the deformable element.

In another embodiment, the deformable element may have a fundamental resonant frequency below an audio spectrum or near a center of the audio spectrum.

BRIEF DESCRIPTION OF THE DRAWINGS

The following detailed description makes reference to the accompanying drawings, which are now briefly described.

Figure 1A:
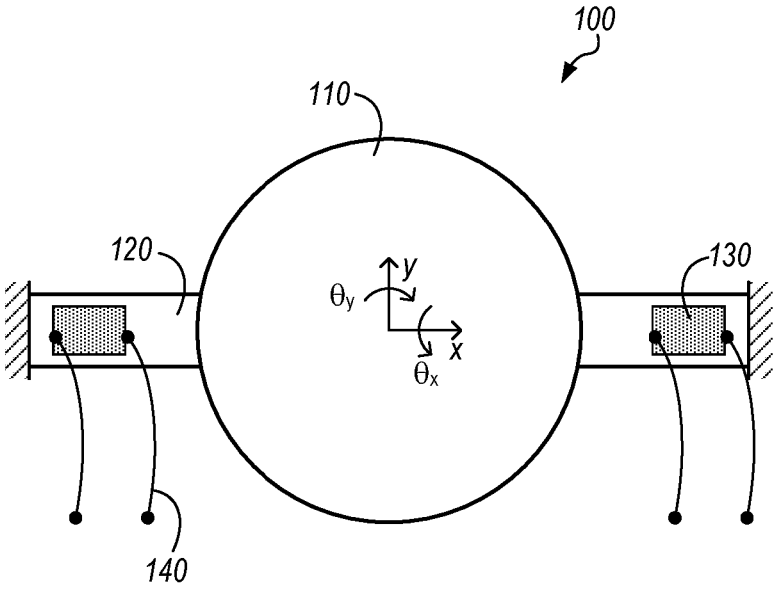
FIG. 1A-1B illustrate exemplary embodiments of a sensor system.

While the invention is susceptible to various modifications and alternative forms, specific embodiments thereof are shown by way of example in the drawings and are herein described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

The headings used herein are for organizational purposes only and are not meant to be used to limit the scope of the description. As used throughout this application, the word "may" is used in a permissive sense (i.e., meaning having the potential to), rather than the mandatory sense (i.e., meaning must). The words "include," "including," and "includes" indicate open-ended relationships and therefore mean including, but not limited to. Similarly, the words "have," "having," and "has" also indicated open-ended relationships, and thus mean having, but not limited to. The terms "first," "second," "third," and so forth as used herein are used as labels for nouns that they precede, and do not imply any type of ordering (e.g., spatial, temporal, logical, etc.) unless such an ordering is otherwise explicitly indicated. For example, a "third component electrically connected to the module substrate" does not preclude scenarios in which a "fourth component electrically connected to the module substrate" is connected prior to the third component, unless otherwise specified. Similarly, a "second" feature does not require that a "first" feature be implemented prior to the "second" feature, unless otherwise specified.

Various components may be described as "configured to" perform a task or tasks. In such contexts, "configured to" is a broad recitation generally meaning "having structure that" performs the task or tasks during operation. As such, the component can be configured to perform the task even when the component is not currently performing that task (e.g., a set of electrical conductors may be configured to electrically connect a module to another module, even when the two modules are not connected). In some contexts, "configured to" may be a broad recitation of structure generally meaning "having circuitry that" performs the task or tasks during operation. As such, the component can be configured to perform the task even when the component is not currently on. In general, the circuitry that forms the structure corresponding to "configured to" may include hardware circuits.

Various components may be described as performing a task or tasks, for convenience in the description. Such descriptions should be interpreted as including the phrase "configured to." Reciting a component that is configured to perform one or more tasks is expressly intended not to invoke 35 U.S.C. §112, paragraph six, interpretation for that component.

The scope of the present disclosure includes any feature or combination of features disclosed herein (either explicitly or implicitly), or any generalization thereof, whether or not it mitigates any or all of the problems addressed herein. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

DETAILED DESCRIPTION OF THE INVENTION

Terms

Approximately—refers to a value that is almost correct or exact. For example, approximately may refer to a value that is within 1 to 10 percent of the exact (or desired) value. It should be noted, however, that the actual threshold value (or tolerance) may be application dependent. For example, in one embodiment, "approximately" may mean within 0.1% of some specified or desired value, while in various other embodiments, the threshold may be, for example, 2%, 3%, 5%, and so forth, as desired or as required by the particular application. Furthermore, the term approximately may be used interchangeable with the term substantially. In other words, the terms approximately and substantially are used synonymously to refer to a value, or shape, that is almost correct or exact.

Couple—refers to the combining of two or more elements or parts. The term "couple" is intended to denote the linking of part A to part B, however, the term "couple" does not exclude the use of intervening parts between part A and part B to achieve the coupling of part A to part B. For example, the phrase "part A may be coupled to part B" means that part A and part B may be linked indirectly, e.g., via part C. Thus part A may be connected to part C and part C may be connected to part B to achieve the coupling of part A to part B.

Functional Unit (or Processing Element)—refers to various elements or combinations of elements. Processing elements include, for example, circuits such as an ASIC (Application Specific Integrated Circuit), portions or circuits of individual processor cores, entire processor cores, individual processors, programmable hardware devices such as a field programmable gate array (FPGA), and/or larger portions of systems that include multiple processors, as well as any combinations thereof.

User Equipment (UE) (or "UE Device")—refers to any of various types of computer systems devices which are mobile or portable and which performs wireless communications. Examples of UE devices include mobile telephones or smart phones (e.g., iPhone™, Android™-based phones), portable gaming devices (e.g., Nintendo DS™, Play Station Portable™, Gameboy Advance™, iPod™), laptops, tablets (e.g., iPad™, Android™-based tablets), PDAs, portable Internet devices, music players, data storage devices, or other handheld devices, etc. In general, the term "UE" or "UE device" can be broadly defined to encompass any electronic, computing, and/or telecommunications device (or combination of devices) which is easily transported by a user and capable of wireless communication.

Trans-impedance amplifier—refers to a current to voltage converter, most often implemented using an operational amplifier.

Piezoelectric sensor—refers to a sensor that relies on the piezoelectric effect, i.e., the electromechanical interaction between the mechanical and the electrical state in a certain class of materials.

Open-circuit voltage—refers to the difference of electrical potential between two terminals of a device when disconnected from any circuit.

Short-circuit charge—refers to charge moved between electrodes of a sensor when the voltage across the sensor is zero.

Short-circuit current—refers to the current moved between electrodes of a sensor when the voltage across the sensor is zero.

Audio Spectrum—refers to the portion of the frequency spectrum that is audible to humans. In general, audible frequencies range from approximately 20 Hz on the low end to 20,000 Hz on the high end. Thus, the audio spectrum is considered to span from 20 Hz to 20 kHz. In general, the center of the audio spectrum may be considered to be approximately 1 kHz.

Wave number—refers to the spatial frequency of a wave, either in cycles per unit distance or radians per unit distance.

Figure 2A:
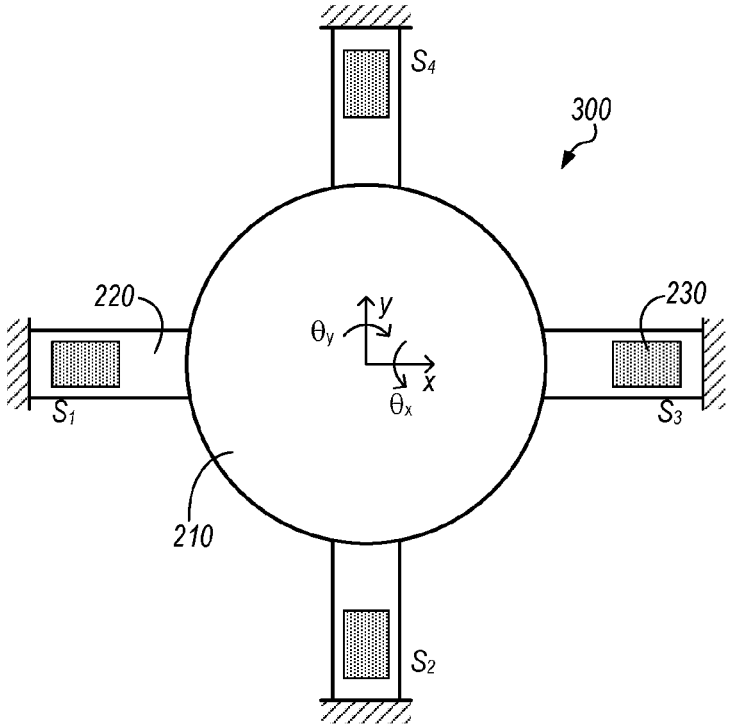
FIGS. 2A-2C illustrate further embodiments of a sensor system.
Figure 2B:
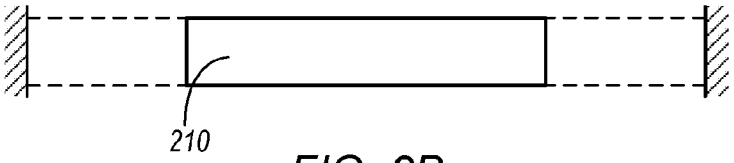
Figure 2C:
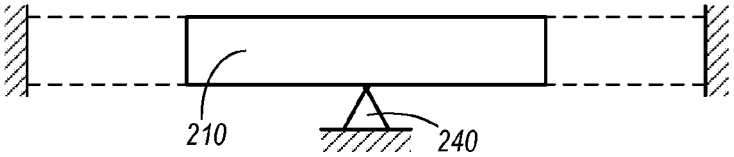
Figure 3:
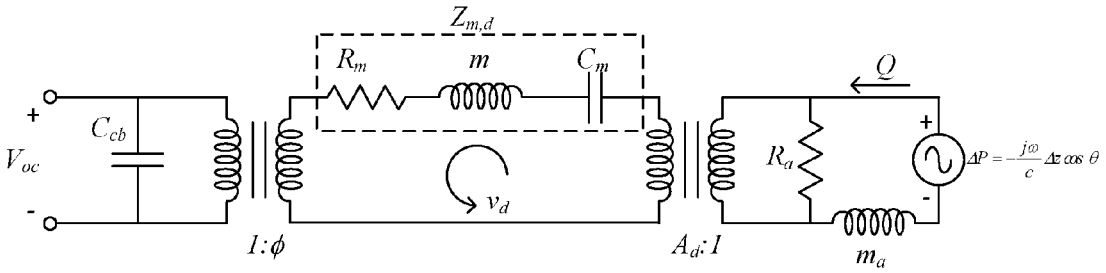
FIG. 3 illustrates an exemplary model of a directional microphone according to embodiments of the invention.

FIGS. 1-3: Embodiments of a Directional Microphone

FIG. 1A illustrates an exemplary embodiment of a sensor system. In certain embodiments, the sensor system may be a directional microphone. As shown, a diaphragm 110 of a deformable element 100, or sensing element, may be coupled to at least two springs 120. The deformable element may include a material that is subject to deformation in response to an external phenomenon, such as air, or sound, pressure. In some embodiments, at least one sensing port, such as sensing port 130 may be disposed on each spring 120. In such a configuration, diaphragm 110 may, in a first mode of vibration, deflect uniformly in an out of plane direction (i.e., along the z-axis, not shown). Accordingly, in a second mode of vibration, the diaphragm may rotate about the x-axis, generating an angle $\theta_x$, and, in a third mode of vibration, the diaphragm may rotate about the y-axis, generating an angle $\theta_y$, The deflections may generate signals at electrodes 140 via sensing port 130. In one embodiment, the signals may be useable to determine spatial dependencies of the external phenomenon. In certain embodiments, the external phenomenon may be pressure, thus, the signals may be useable to determine spatial dependencies of the pressure. Thus, a single structure may serve as a tri-axial pressure gradient sensor because the shape of deformation of the structure may provide information regarding the spatial pressure gradients. Accordingly, the first mode deformation may be induced by z-axis pressure gradients, the second mode of deformation may be induced by y-axis pressure gradients, and the third mode of deformation may be induced by x-axis pressure gradients. Hence, the multiple electrodes on the multiple springs may be used to discern the deformation shape of the structure and, in-turn, discern the instantaneous pressure gradients. Further, as shown, sensing ports 130 may be applied to, or placed on, one or more of springs 120. In some embodiments sensing ports 130 may be piezoelectric film. In such embodiments, it may be desirable to use piezoelectric transduction as compared to capacitive and optical readout techniques. Piezoelectric transduction may be more suitable for designing in the direction of high compliance because (i) no bias voltage is required, (ii) compromised planarity of surfaces that can result from fabrication of compliant structures is not critical, and (iii) low thermal-mechanical noise may be more achievable since reference electrodes are not required.

Additionally, it is noted that signals from electrodes, such as electrodes 140 may be summed or subtracted in any number of configurations. Some electrodes may be used for sensing, while others used for actuation. This may enable closed-loop operation in which forces are fed back to the actuation ports to alter the frequency response or dynamics of the structure. In a particular embodiment, the forces fed back to the actuation electrodes are in proportion to and opposite the sign of the measured diaphragm velocity and serve to reduce the resonance quality factor, Q.

In another embodiment, the forces fed back to the actuation electrodes are in proportion to and of the same sign as the measured sensing element displacement—creating positive feedback. This serves to soften the structure and reduce its resonant frequency. Thus, for example, a device with an open-loop resonance of 1,000 Hz may be made to have a closed-loop resonance of 100 Hz which may be helpful in realizing a traditional ribbon microphone frequency response.

Additionally it should be noted that a deformable element may be any of various elements that are deformable. Thus, the term deformable element may be a single cantilever beam that may include sensing ports, a diaphragm and spring structure that may include sensing ports as described above with respect to FIG. 1, or any of the below described embodiments of deformable elements or sensing elements, among other others. Further, in certain embodiments, the material of the deformable element may be piezoelectric material. In other embodiments, the material of the deformable element may be another material configured to produce a voltage when deformed. In such embodiments, each sensing port may be pairs of electrodes.

Figure 1B:
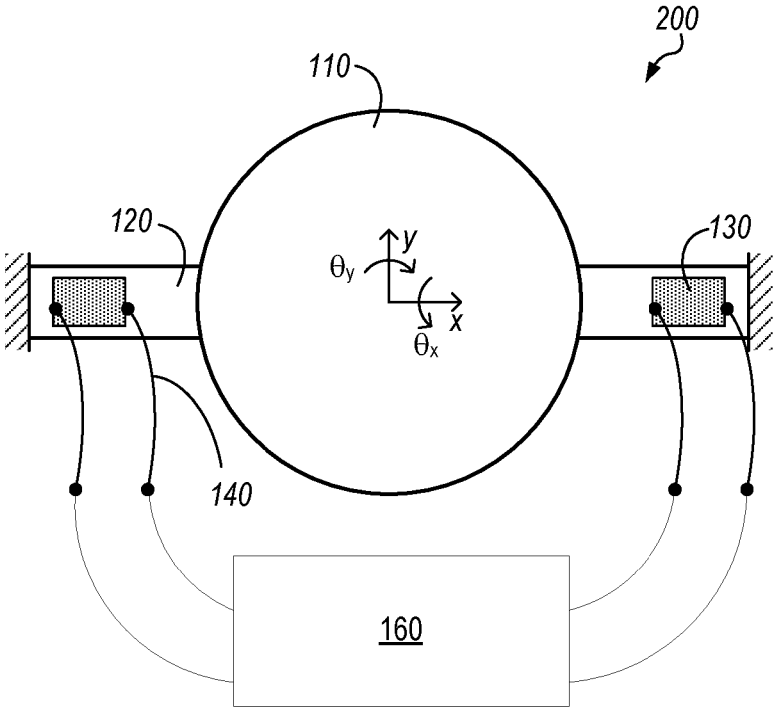

FIG. 1B illustrates another exemplary embodiment of a sensor system. In certain embodiments, the sensor system may be a directional microphone. As shown, the microphone system may include a deformable element 200 and a functional unit 160. Deformable element 200 may be similar to, or the same as, deformable element 100 described above in reference to FIG. 1A. Thus, similar elements are labelled accordingly. Hence, deformable element 200 may include a diaphragm 110 and springs 120. Sensing ports 130 may be connected to springs 120 and may be configured to sense a deformation of a corresponding respective region of deformable element 200 and generate a signal in response thereto. Thus, electrodes 140 may couple to sensing ports 130 and provide signals that are useable by functional unit 160 to determine spatial dependencies of an external phenomenon, such as pressure, or sound pressure. Thus, in some embodiments, the functional unit may use the signals to determine spatial dependencies of the pressure, or sound pressure.

FIG. 2A illustrates another exemplary embodiment of a directional microphone. In such an embodiment, a deformable element, such as sensing element 300, may include multiple springs 220 that may couple to diaphragm 210 and may be used to simultaneously measure pressure and pressure gradients from a single structure using signals $S_1$ to $S_4$ generated from piezoelectric film 230 placed on each spring 220. Thus, pressure gradients along the x-axis tend to deform the sensing element about the y-axis, generating $\theta_y$. Note that such deformation may generate opposing polarity for $S_1$ as compared to signal $S_3$. Hence, the signal subtraction operation "$S_1$-$S_3$" may be used to measure $\theta_y$. Similarly, pressure gradients along y-axis may generate rotation about the x-axis, denoted $\theta_x$. Accordingly, signal operation "$S_4$-$S_2$" may be used to measure $\theta_x$. Additionally, omnidirectional sound pressure and pressure gradients along the z-axis (not shown) may deflect the sensing element uniformly and may generate signals $S_1$ to $S_4$ of similar polarity. Thus, the omnidirectional pressure and/or the z-axis pressure gradient may be measured by the signal addition operation "$S_1+S_2+S_3+S_4$".

Note further, that since signals $S_1$ to $S_4$ may all be available simultaneously and the addition and subtraction operations described may be performed simultaneously for simultaneous measurement of gradients along each axis (x, y, and z). Accordingly, in various embodiments, addition and subtraction of signals may be performed in passive analog domain or after amplification of signals in the analog or digital domain. In some embodiments, a functional unit may be coupled to the deformable element and may be configured to perform the above described addition and subtraction of signals.

Additionally note that the embodiment shown in FIG. 2A is exemplary only and one of many potential configurations or embodiments of the invention. As shown in FIG. 2B, in certain embodiments, the sensing element may be freely suspended at the center of diaphragm 210, or alternatively, as shown in FIG. 2C, a point pivot 240 may be included at the center of diaphragm 210 and may be configured to alter the vibration modes and resonance frequency of vibration modes of the directional microphone.

In certain embodiments, a micro-fabrication process flow may be utilized to realize a directional microphone with out-of-plane directivity (e.g., a $\partial P/\partial z$ acoustic sensor). A highly compliant mechanical structure (e.g., ribbon), such as those described above in reference to FIGS. 1 and 2, with both front and back sides open to the ambient may result in a pressure-gradient sensor with a dipole directivity response. Although true ribbon microphones may be designed with a fundamental mechanical resonance at the lower end of an audio band, with the velocity of the ribbon demonstrating a flat response with respect to pressure above the fundamental resonance and throughout the audio band, microphones according to embodiments of the invention may have a high mechanical compliance and fundamental resonant frequencies in the center of the audio band.

In some embodiments, high sensing element compliance may be desirable to achieve high signal-to-noise ratio (SNR), and more specifically, to compensate for the inherent loss in drive pressure associated with small-scale pressure gradient sensors. The ratio of drive pressure $\Delta P$ to acoustic signal pressure $P_0$ is $\Delta P/P_0=-jk\Delta z$, where k is the acoustic wave number.

Furthermore, for certain embodiments of the invention, the dynamics of the device may be modeled using network analogs commonly employed in the modeling of multiple physical domain transducers as shown in FIG. 3. Thus, a first-order Taylor-series expansion of an incident plane wave yields an expression for the acoustic pressure differential $\Delta P$ across the front to back port: $\Delta P=-j\ (\omega/c)\ \Delta z \cos\theta$, where $\omega$, c, $\theta$, and $\Delta z$ are angular frequency of incident sound, sound speed, angle of incidence with respect to the z-axis, and front to back-port spacing, respectively. Note that inertia of the oscillating air parcel occupying the back cavity is represented by acoustical mass. The front-to-back leakage path introduced by gaps between the springs may be represented by an acoustical resistance in parallel with the mechanical impedance of the diaphragm. The transformer ratio $\phi$, by definition, is the short-circuit charge generated per sensing element (and spring) deflection. For analysis of thin films atop significantly thicker passive structures such as may be present in embodiments of the invention, the strain field at the spring surface is assigned to the piezoelectric film and the resulting charge is integrated to obtain $\phi$. For clamped-guided-type spring deflection (i.e., "S"-shaped deflection) and electrodes covering half the spring of length L, $$\phi = \frac{3w_e h}{4L} e_{31f} \tag{1}$$

where $w_e$, h and $e_{31f}$ are the electrode width, spring thickness, and effective $e_{31}$ material property. $e_{31f}$ is a material property relating charge generation for a given strain of the material.

FIG. 4 to FIG. 11: Further Embodiments of a Directional Microphone

Figure 4A:
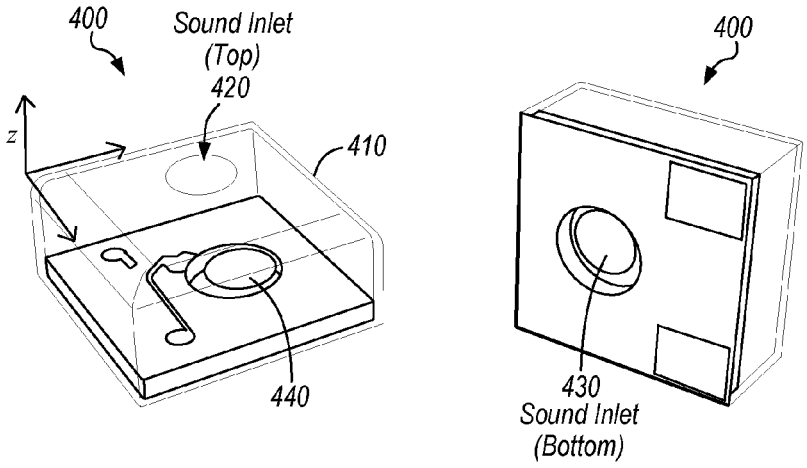
FIGS. 4A-4C illustrate an embodiment of a directional microphone including a sensing element forming a portion of the directional microphone.
Figure 4B:
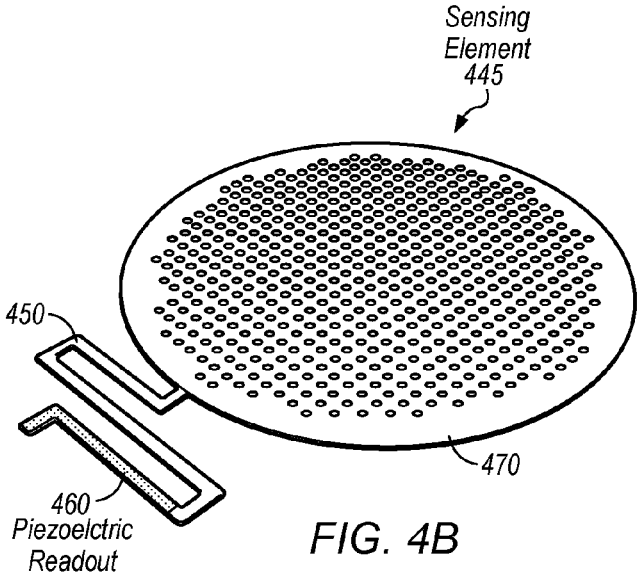
Figure 4C:
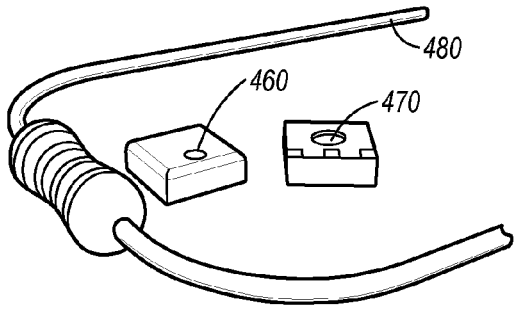

FIGS. 4A-4C illustrate a directional microphone according to embodiments of the invention. In certain embodiments, a directional microphone may include a container that may include a first opening on a first side and a second opening on a second side. Note that the second side may be substantially opposite the first side. Additionally, the directional microphone may include a sensing element.

As shown in FIG. 4A, directional microphone 400 may include a sensing element 440 and the sensing element 440 may form a portion of the directional microphone. Sensing element 440 may be similar to or the same as the deformable elements described above in reference to FIG. 1 and the sensing element described above in reference to FIG. 2. Additionally, the directional microphone 400 may include container 410. Container 410 may include a first opening in a first side of the container such as sound inlet 420 on the top side of container 410. Further, the container 410 may include a second opening in a second side of the container such as sound inlet 430 on the bottom side of container 410. In certain embodiments, the directional microphone may also include a functional unit such as the functional unit described above in reference to FIG. 1B. Thus, in certain embodiments, sensing element 440 may provide signals to a functional unit that may be usable by the functional unit to determine spatial gradients of sound pressure acting on the sensing element 440.

FIG. 4B illustrates sensing element 445 which may be similar to or the same as sensing element 440 described above in reference to FIG. 4A. Sensing element 445 may be directly coupled to a substrate on which it may be fabricated. Thus, in one embodiment in which MEMS may be used, the substrate may be silicon. In turn, the substrate may be coupled to the container using a cantilevered elongated member, such as spring 450. Additionally, a piezoelectric film, or readout, such as piezoelectric readout 460 may be placed, or adhered to, cantilevered elongated member 450. Additionally, sensing element 445 may include, or be, diaphragm 470. As shown, diaphragm 470 may be substantially, or approximately, circular. Note however, in other embodiments, diaphragm 470 may be substantially, or approximately square. Further, although the shape of the diaphragm of the sensing element may be typically described herein as approximately circular, the shape of the diaphragm of the sensing element may not be limited to any particular shape or geometry. Further, although FIG. 4B depicts a single sensing element for readout 460, multiple independent sensing elements for readout 460 may reside at various positions along the length of the spring.

FIG. 4C illustrates an embodiment of the invention, and for illustrative purposes, a common electrical resistor 480. Not that inlet hole 460 and outlet hole 470 may be similar to sound inlets 420 and 430 described above in reference to FIG. 4A. In certain embodiments, the container may include a sensing element positioned in the container. The sensing element may sense, during use, sound energy. The sensing element may be coupled to the container using a cantilevered elongated member such as spring 450. Further, in some embodiments the container may include a functional unit as described above. Additionally, in contrast to traditional omni-directional microphones which have a sealed backside cavity, the sound inlet and outlet openings in the container may allow sound to pass through the openings and interact with the sensing element.

In certain embodiments, the structure may be made light weight via the use of thin micro-fabricated surface layers. Additionally, in an exemplary embodiment, perforations may be etched into the material to further reduce the weight of the structure.

Additionally, in some embodiments, the sensing element may be oriented out of plane relative to the sound energy detected by the sensing element. Further, in an exemplary embodiment, the sensing element may move, deflect, displace, or deform in response to sound energy entering at least the first opening. In one embodiment, the sound energy may be measured by measuring an open-circuit voltage generated by the movement, deflection, displacement, or deformation of the sensing element. Accordingly, the open-circuit voltage may be directly proportional to a displacement of the sensing element. In another embodiment, the sound energy may be measured by measuring a short-circuit charge generated by movement of the sensing element. Accordingly, the short-circuit charge may be directly proportional to a displacement of the sensing element. In yet another embodiment, the sound energy may be measured by measuring a short-circuit current generated by movement of the sensing element. Accordingly, the short-circuit current may be directly proportional to a velocity of the sensing element. In one embodiment, the short-circuit current may be measured using a trans-impedance amplifier (TIA).

In certain embodiments, the directional microphone may include at least a first cover covering at least a portion of the first opening such that bulk air flow is inhibited from moving the sensing element. In other words, at least a portion of the first opening may be covered such that wind and air pressure associated with wind, i.e., bulk air flow, is inhibited from moving the sensing element. In such embodiments, the cover may be configured to inhibit noise associated with wind, i.e., wind noise. Note that wind noise in a microphone signal input to user equipment has been recognized as a problem that can greatly limit communication quality. Additionally, this problem has been well known in the hearing aid industry. Further, such wind sensitivity of microphones has been a major problem for outdoor recordings.

Relatedly, the susceptibility of microphones of user equipment to the flow of air from a speaker's mouth may also diminish communication quality. Thus, in some embodiments, the device may include a first cover covering at least a portion of the first opening and a second cover covering at least a portion of the second opening such that bulk air flow is inhibited from moving the sensing element. In certain embodiments, coverings may be formed from, for example, mylar. Additionally, these coverings may be configured as protective coverings and may block "DC" wind and "puff" noise while letting acoustic pressure waves pass through.

Figure 5A:
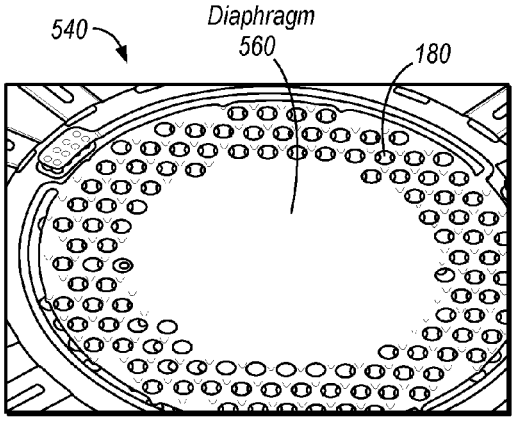
FIGS. 5A-5C illustrate an embodiment of a sensing element.
Figure 5B:
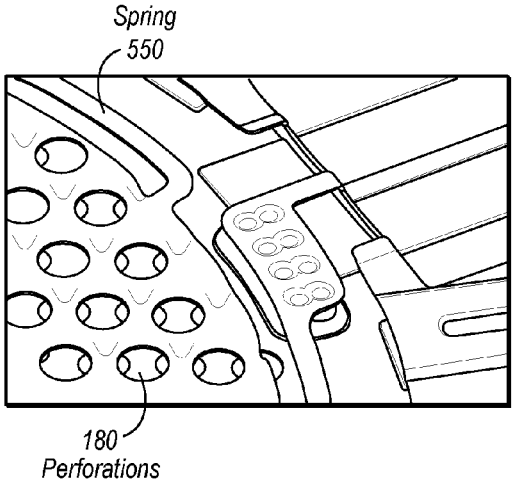
Figure 5C:
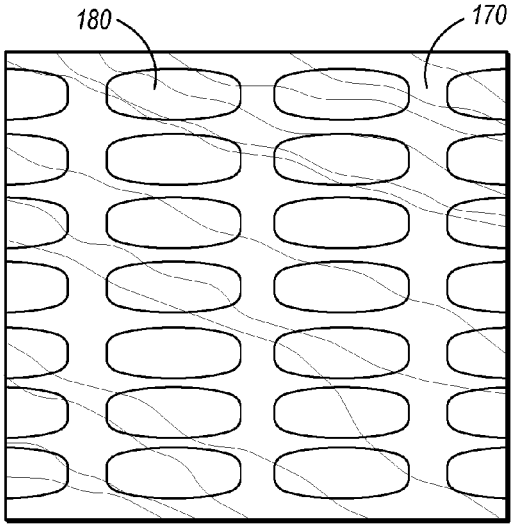

FIGS. 5A-5C illustrate sensing element 540. Sensing element 540 may be similar to or the same as sensing element 440 of FIGS. 4A-4B. According to certain embodiments, diaphragm 560 may include a plurality of openings 180 extending through the sensing element. At least some of the plurality of openings may be sized, or configured, such that gases are inhibited, during use, from being conveyed through the plurality of openings. Additionally, the openings may reduce mass of the structure of the sensing element, but may be made small enough, or configured, to introduce a high resistance of air flow through them. This may be enabled by modern micromachining techniques. The ultra-low mass of the structure, combined with the high compliance afforded by the serpentine cantilever elongated member, or spring, may enable a highly compliant structure with low resonant frequency.

In some embodiments, the cantilevered elongated member may be configured to limit the directional microphone's resonant frequency below an audio spectrum or near a center of the audio spectrum. The audio spectrum refers to the portion of the frequency spectrum that is audible to humans. In general, audible frequencies range from approximately 20 Hz on the low end to 20,000 Hz on the high end. Thus, the audio spectrum is considered to span from 20 Hz to 20 kHz. In general, the center of the audio spectrum may be considered to be approximately 1 kHz. Thus, in certain embodiments, below an audio spectrum may refer to a resonant frequency less than approximately 100 Hz. Additionally, the center of the audio spectrum may be approximately 1 kHz. Further, the top, or upper bound, of the audio spectrum may be approximately near 20 kHz. Note that in traditional ribbon microphones, adjustment of the resonant frequency to the lower end or center of the audio spectrum may only be possible with very large structures several inches long. However, modern micromachining technology may allow fabrication of a very compliant serpentine spring structure defined precisely with photolithography and chemical etching.

As shown in FIG. 5B, sensing element 540 may include a sensing structure which may include a serpentine spring structure. In other words, sensing element 140 may include long springs 550 that run along the circumference of a circular, perforated disk, such as diaphragm 560. As shown, diaphragm 560 may include perforations 180. In certain embodiments, at least some of the perforations 180 may be configured to inhibit gases, from being conveyed through perforations 180 during use. Additionally, perforations 180 may reduce mass sensing element 540. Accordingly, perforations 180 may be configured to introduce a high resistance of air flow through the openings in diaphragm 560.

As illustrated in FIG. 5C, in some embodiments, the device may include a coating covering at least a portion of perforations 180 such that gases may be inhibited from conveying through the covered, or coated, perforations 180. Thus, the perforated diaphragm may include light-weight coating 170 over the openings to impede air flow. In certain embodiments, the light-weight coating 170 may be paralyne, graphene or any other light weight carbon fabric (e.g. drawn carbon nanotubes) and may be applied across the diaphragm to assist with sealing the holes. In an exemplary embodiment, the "hybrid" diaphragm may be formed form a skeletal frame of a thicker material such as perforated silicon, for example, and a coating, or "skin," of a thin material, such as carbon, for example, to accomplish sealing, or covering, of the holes. Note that other materials may be used to form the skeletal frame and coating.

Figure 6:
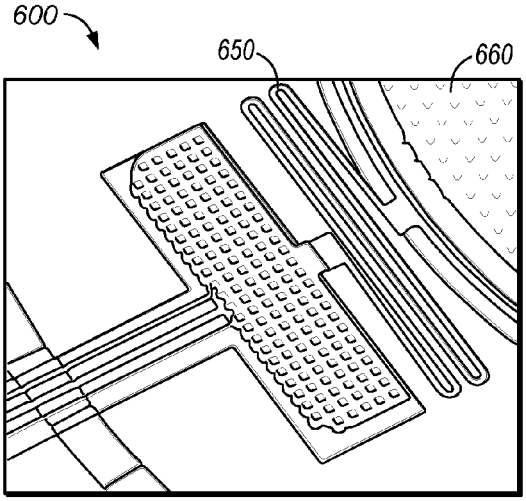
FIG. 6 illustrates an embodiment of a cantilevered elongated member coupling a sensing element to a silicon substrate, which is in-turn coupled to a container of a directional microphone.

FIG. 6 illustrates a sensing element 600 according to an embodiment of the invention. As shown, sensing element 600 may include diaphragm 660 and cantilevered elongated member 650. Note that diaphragm 660 and elongated member 650 may include features and embodiments discussed above in reference to the above Figures. Additionally, in certain embodiments, elongated member 650 may couple sensing element 600 to a silicon die which is in-turn coupled to a container of a directional microphone.

Figure 7A:
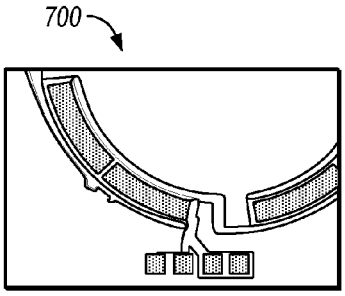
FIGS. 7A-7C illustrate an embodiment of the invention including multiple piezoelectric electrodes on each spring.
Figure 7B:
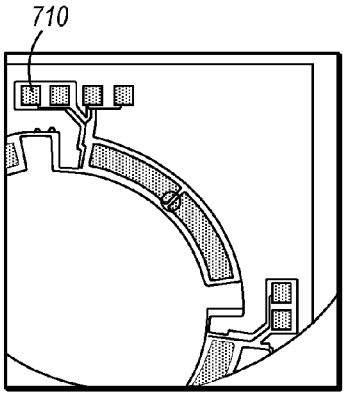
Figure 7C:
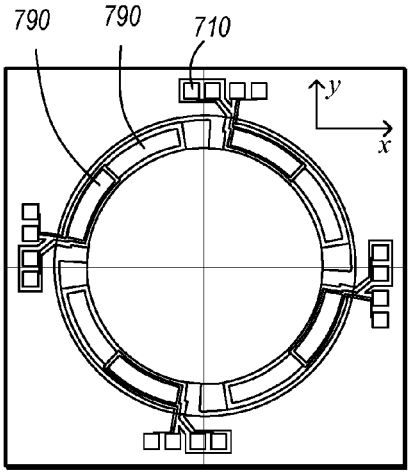

FIGS. 7A-7C illustrate sensing element 700 according to embodiments of the invention. In some embodiments, the sensing element 700 may include at least one piezoelectric sensing apparatus coupled to the cantilevered elongated member. Multiple piezoelectric sensing structures may be placed at various positions on the spring and may enable measurement of beam strain at various points along the length of the spring. Accordingly, in the case of sensing elements that may include multiple springs, multiple piezoelectric electrodes may be placed on each spring. As illustrated sensing element 700 may include multiple springs and each spring may include two electrodes 790. The signals from electrodes may be routed to wire bond pads 710 as shown in FIG. 7B.

As shown in FIG. 7C, sensing element 700 may include 8 electrodes, however, this embodiment is exemplary only and other numbers of electrodes are envisioned. Additionally, in some embodiments, sensing methods other than piezoelectric may be used, including electrostatic, optical, and piezoresistive. Further, in certain embodiments, a combination of sensing methods may also be used (e.g. sensing electrostatically and actuating piezoelectrically).

In one embodiment, piezoelectric readout may be accomplished in a 3-1 configuration, in which case the electrodes run parallel to each other, or in a 3-3 mode fashion of piezoelectric transduction, in which an interdigitated electrode may be patterned on top or on bottom of the piezoelectric film. The implementation of 3-1 mode and 3-3 mode piezoelectric transduction is well known to those skilled in the art. IDT configuration. Note that in a 3-1 configuration strain on the top surface of a spring due to bending results in a Poisson strain in the film and a resulting electric field normal to the spring's top surface.

Figure 8A:
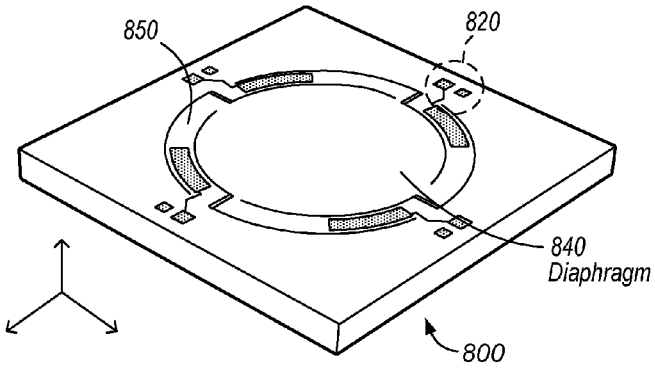
FIGS. 8A-8C illustrate a sensing element according to an embodiment of the invention.
Figure 8B:
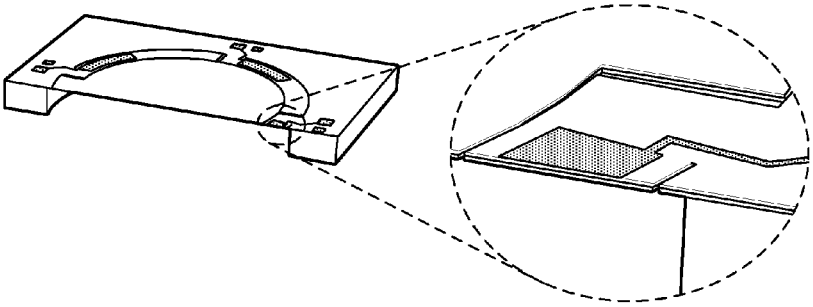
Figure 8C:
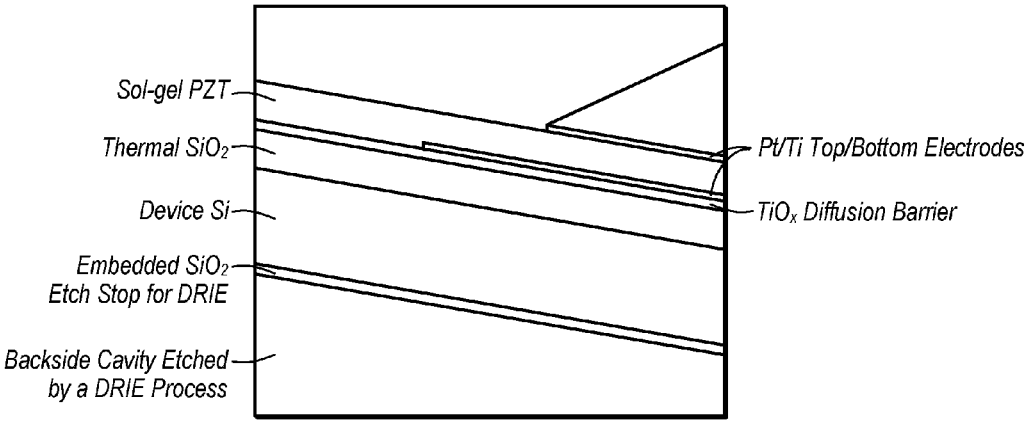

FIGS. 8A-8C illustrate sensing element 800. Sensing element 800 may include an approximately circular diaphragm 840 supported by four circumferential springs 850. In other words the diaphragm may be supported by multiple elongated spring members. Circumferential springs 860 may couple to wire bond pads such as piezoelectric top/bottom electrode bond-pads 820. In certain embodiments, as shown in FIG. 8B, the backside cavity may be etched using a deep reactive ion etch (DRIE) process. Accordingly, The DRIE process may be used to create an open back-cavity and to realize a circular diaphragm freely suspended by the circumferential springs.

FIG. 8C illustrates an exemplary cross section of sensing element 800. As shown, both diaphragm and springs may be etched into a 10-μm-thick epitaxial silicon layer of a silicon-on-insulator (SOI) wafer. It should be noted that the thickness of the epitaxial silicon layer is exemplary only and other thickness are envisioned. The top surface of each spring may contain a layered piezoelectric sensing structure extending from the spring base to approximately half the spring length. In one embodiment, the piezoelectric sensing structure may be a platinum-lead-zirconate-titanate-platinum (Pt-PZT-Pt) sensing structure. In certain embodiments, the titanium-oxide ($TiO_x$) layer may serve as a lead diffusion barrier, while the buried oxide of the SOI wafer may serve as an etch stop for a backside DRIE. In certain embodiments, the piezoelectric films may operate in the 3-1 mode. Additionally, in one embodiment, electrodes may be routed to the edge of the chip for wire bonding. Note that in certain embodiments, the electrodes may be Pt electrodes.

Figure 9A:
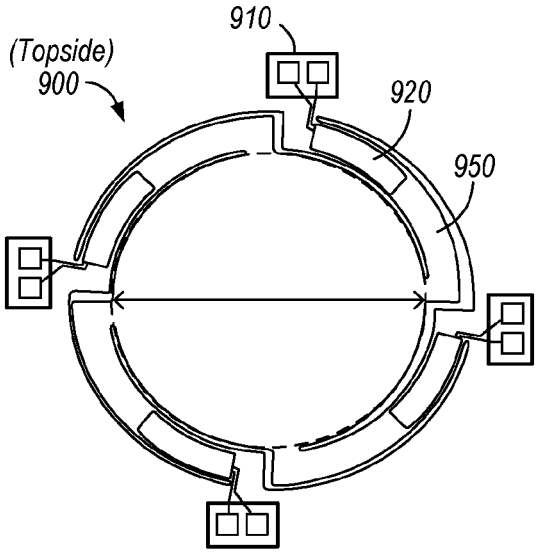
FIGS. 9A-9B illustrate a sensing element according to another embodiment of the invention.
Figure 9B:
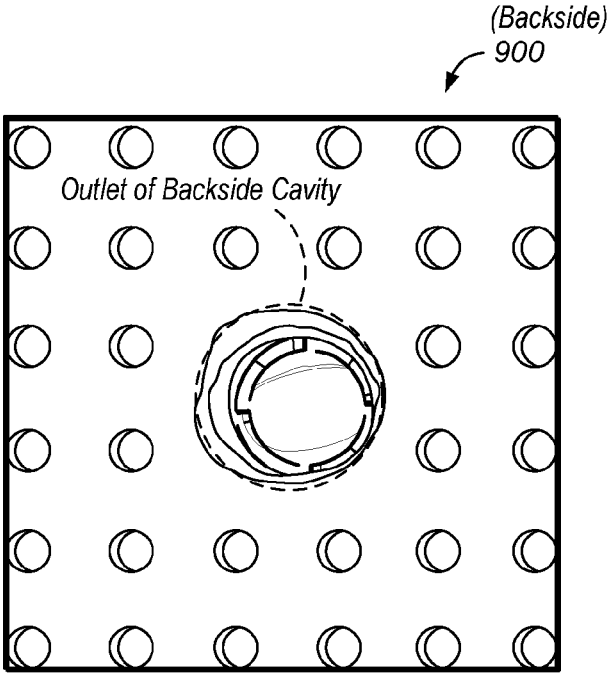

FIGS. 9A-9B illustrate a packaged sensing structure 900 shown from the (A) topside and (B) backside. As shown, sensing structure 900 may include multiple springs 950 with corresponding electrodes 920 and bond-pads 910. Sensing structure 900 may be similar to or the same as the sensing elements described above in reference to FIGS. 1 to 8.

Figure 10:
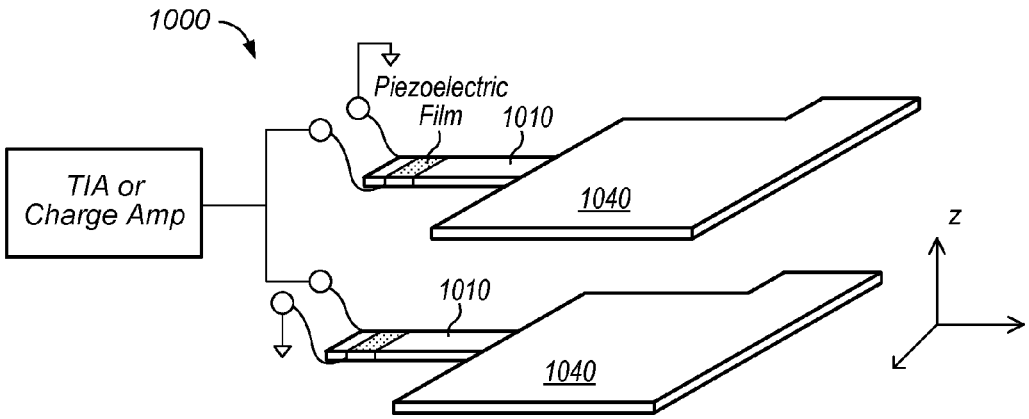
FIG. 10 illustrates an embodiment of a cascade of entrained microphones used to measure higher order pressure derivatives along an axis.

FIG. 10 illustrates sensing elements 1010 of directional microphone 1000 according to embodiments of the invention. Each sensing element 1010 may include a diaphragm 1040. The sensing elements 1010 may be substantially aligned along a z-axis such that the z-axis runs through (for example, in an orthogonal orientation to) the planes which the sensing elements are positioned in. Thus, in some embodiments, a directional microphone may include a cascade of entrained diaphragms 1040, stacked along the z-axis, for higher order pressure gradient sensing. A single entrained microphone enables measurement of the pressured gradient, $$\frac{dP}{dx},$$

at a point along tne z-axis. Thus, use of multiple diaphragms stacked along the z-axis (which may be realized in a single structure using wafer bonding processes) results in multiple $$\frac{dP}{dx}$$

measurements along the z-axis. Further, the multiple measured gradients may then be used to estimate higher order gradients, i.e., derivatives such as $$\frac{d^2P}{dx^2}.$$

Measurement of such higher order pressure gradients may be useful for acoustic signal processing purposes. Accordingly, using direct charge or current subtraction, small electrical signals proportional to higher-order pressure gradients along the z-axis may be generated passively before being buffered with analog electronics.

Figure 11A:
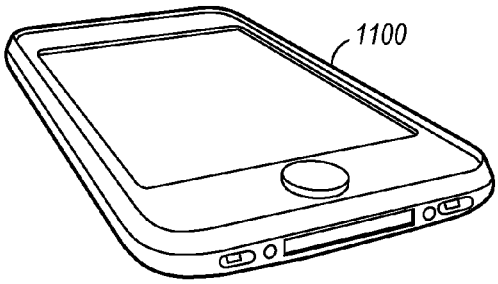
FIGS. 11A-11C illustrate an exemplary application of embodiments of the invention.
Figure 11B:
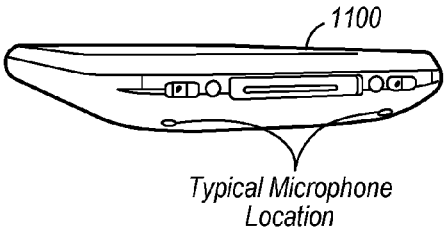
Figure 11C:
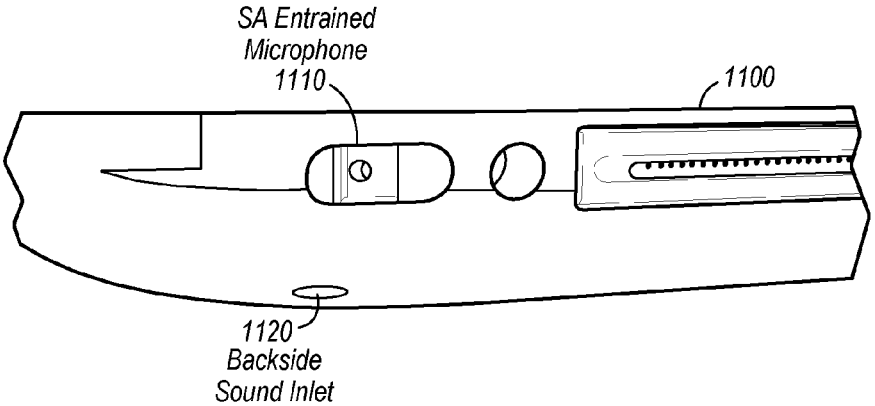

FIGS. 11A-11C illustrate user equipment 1100 which may include embodiments of the invention. Note that although user equipment 1100 is illustrated as a cellular phone, the term user equipment is not limited to cellular phone. The term is intended to refer to any of various types of computer systems devices which are mobile or portable and which performs wireless communications. Examples of UE devices include mobile telephones or smart phones (e.g., iPhone™, Android™-based phones), portable gaming devices (e.g., Nintendo DS™, PlayStation Portable™, Gameboy Advance™, iPod™), laptops, tablets (e.g., iPad™, Android™-based tablets), PDAs, portable Internet devices, music players, data storage devices, or other handheld devices, etc. In general, the term "UE" or "UE device" can be broadly defined to encompass any electronic, computing, and/or telecommunications device (or combination of devices) which is easily transported by a user and capable of wireless communication.

As shown, user equipment 1100 may include one or more directional microphones 1110 which may include embodiments of the invention. In some embodiments, no modification to the user equipment 1100 may be necessary. In other embodiments, the addition of a small backside sound inlet, such as backside sound inlet 1120, to the directional microphone 1110 may improve directivity and/or signal to noise ratio performance.

Figure 12A:
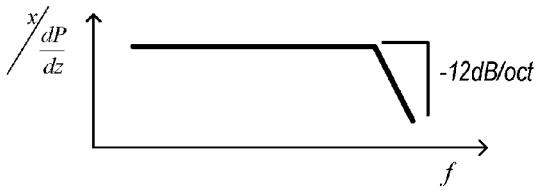
FIGS. 12A-12D illustrate exemplary response curves of several embodiments of the invention.
Figure 12B:
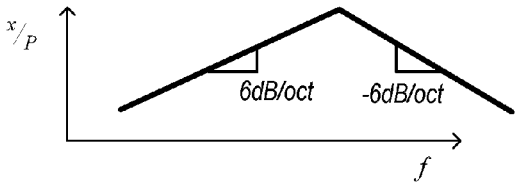

FIGS. 12A-12D illustrate exemplary response curves of several possible embodiments. For example, FIGS. 12A-12B illustrate an exemplary response curve of an embodiment of the invention that may have a flat, or constant, response with respect the pressure gradient $$\left(\frac{dP}{dx}\right).$$

Thus, as illustrated in FIG. 12A, the displacement (x) of the diaphragm of the sensing element, with respect to pressure gradient $$\left(\frac{dP}{dx}\right)$$

may be constant. Additionally, such an embodiment, as illustrated, may have a resonant frequency positioned at the high, or top, end of the audio spectrum. FIG. 12B illustrates the response of the diaphragm displacement (x) with respect to pressure amplitude (P) corresponding to the pressure gradient response curve of FIG. 12A.

Figure 12C:
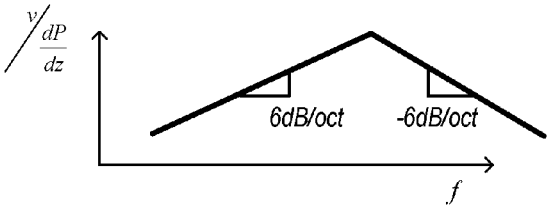
Figure 12D:
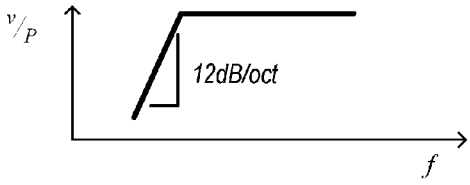

FIGS. 12C-12D illustrate an exemplary response curve of an embodiment of the invention that may have a flat, or constant, response with respect to pressure amplitude. Thus, as illustrated in FIG. 12D, the velocity (v) of the diaphragm of the sensing element, with respect to pressure amplitude (P) may be constant. Additionally, such an embodiment, as illustrated, may have a resonant frequency positioned at the low, or bottom, end of the audio spectrum. FIG. 12C illustrates the response of the diaphragm velocity (v) with respect to pressure gradient $$\left(\frac{dP}{dx}\right)$$

corresponding to the pressure amplitude response curve of FIG. 12D.

Note that the embodiment illustrated in FIGS. 12C-12D uses a design principle similar to the design principle governing conventional ribbon microphones which use magnetic readout of a ribbon with a resonant frequency at the low end of the audio spectrum. Thus, in a further embodiment of the invention, the invention may be considered, or described as, a piezoelectric ribbon microphone. Additionally, in an exemplary embodiment, the invention may be considered a silicon-micro-machined ribbon microphone. Thus, in some embodiments, the sensing element may be fabricated with the lightest materials available such as single atomic layer carbon known as graphene, or carbon materials several atomic layers thick, among others. In such embodiments, the motion of the sensing element above its mechanical resonance, or resonant frequency, may directly match, or correspond to, the acoustic vibrations of the air itself. In other words, the sensing element may be entrained with the vibrations of the air.

Figure 13:
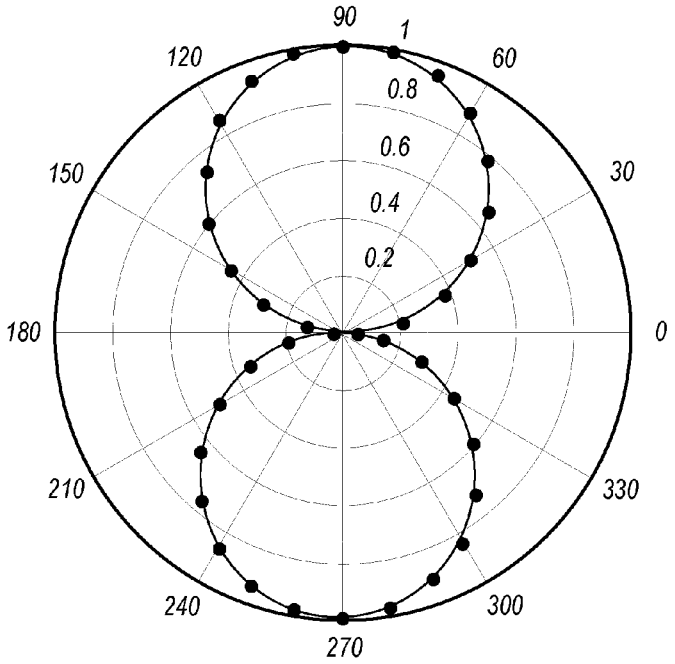
FIG. 13 illustrates measured directivity across a complete 360° (no assumed symmetry) for an exemplary embodiment of the invention.

FIGS. 13 to 14: Exemplary Experimental Data

FIG. 13 illustrates measurement results of open-circuit voltage on an exemplary embodiment of the invention. The measurements were conducted in a 10 foot by 10 foot by 10 foot walk-in anechoic chamber. A studio monitor was used to generate a broadband white-noise input while the open-circuit voltage spectrum of a single port was recorded for a device according to an exemplary embodiment of the invention. To make the measurements, the device was mounted on a low-profile rotational stage allowing for precise control of angular orientation relative to the stationary studio monitor. Measurements spanning one complete rotation, i.e., a complete 360°, were performed. As anticipated, the z-directivity patter was in the form of a figure-of-8.

Figure 14A:
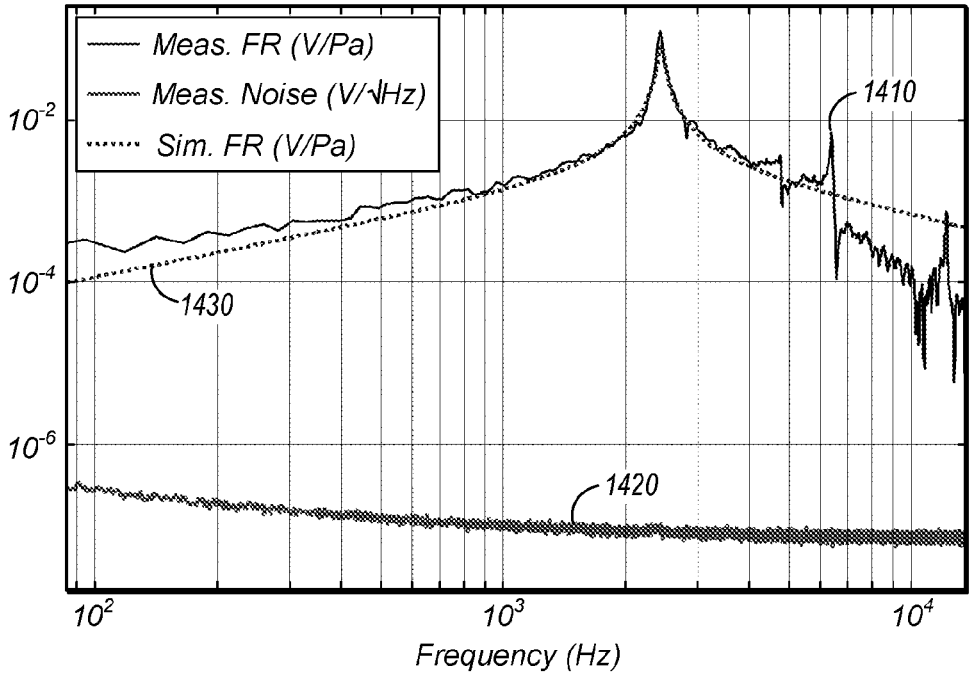
FIGS. 14A-14B illustrate measured and simulated (A) frequency responses and (B) noises including dielectric loss for a single piezoelectric sensor port for an exemplary embodiment of the invention.
Figure 14B:
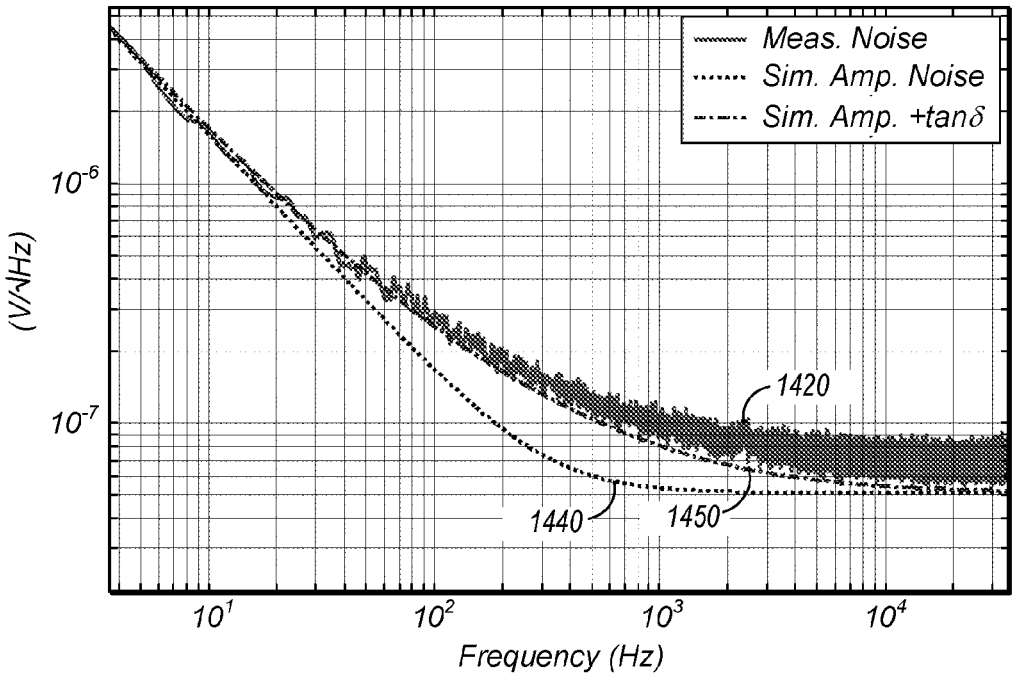

FIGS. 14A-14B illustrate the measured frequency response of an exemplary prototype entrained microphone according to embodiments of the invention. As shown, the measure frequency response is at normal incidence, i.e., the most sensitive orientation of the prototype. Similar to the measurements presented above in reference to FIG. 10, the measurements presented in FIGS. 14A-14B were conducted in a 10 foot by 10 foot by 10 foot walk-in anechoic chamber. A studio monitor was used to generate the frequency response via a broadband chirp signal ranging from 100 Hz to 20 kHz. A single piezoelectric port of the prototype was connected to a non-inverting amplifier and a free-field microphone with a calibrated and flat frequency response to 20 kHz was mounted in close proximity to the prototype. The Fast-Fourier-Transform (FFT) of the measured device signal was normalized to the FFT of measured free-field microphone signal to obtain the frequency response. Measured frequency response 1410 and simulated frequency response 1430 both show an anticipated 20-dB/decade increase in sensitivity with frequency up to proximity of the first mechanical resonance of the prototype, which is at approximately 2600 Hz. Additionally, measured voltage-noise spectral density 1420 is also included in FIG. 14A. Note that the dominant noise source in small-scale piezoelectric sensors is typically thermal-mechanical noise generated by dielectric loss in the piezoelectric film, with the loss itself characterized by the ratio of real to imaginary electrical film impedance, or tan δ. Additionally, tan δ is observed to be approximately constant across a wide frequency range with values in the 0.02 range for micro-fabricated piezoelectric films.

FIG. 14 B illustrates a zoomed-in figure of the measured noise 1420 from FIG. 14A along with simulated amplifier noise 1440 and amplifier+tan δ noise 1450. As can been seen from FIG. 14B, the noise floor of the exemplary prototype is dominated by tan δ noise between 100 Hz-1 kHz (tan δ=0.02 used in simulation), with significant contributions from amplifier noise elsewhere.

Figure 15:
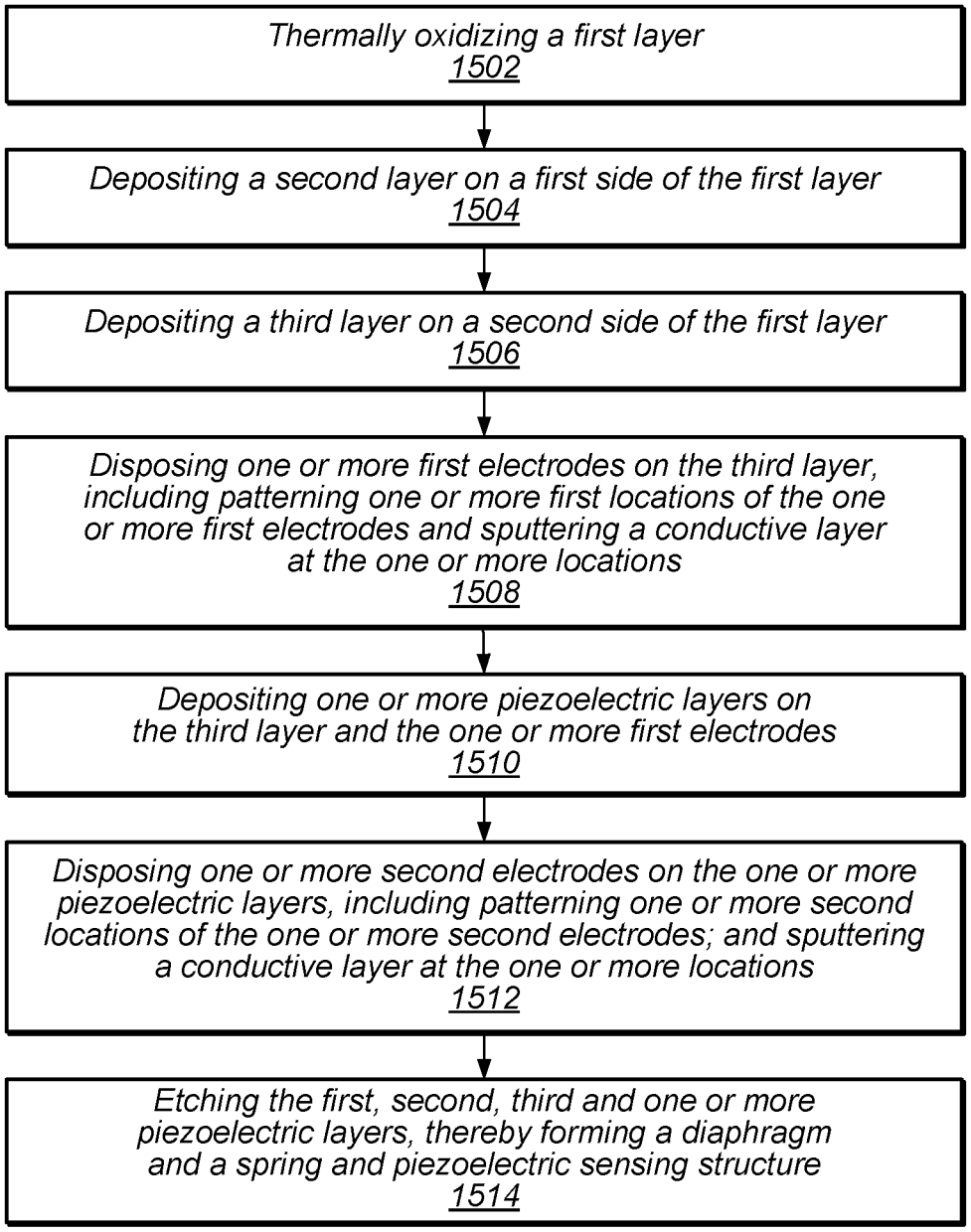
FIG. 15 is a flowchart diagram illustrating one embodiment of a method for fabricating a directional microphone according to embodiments of the invention.

FIG. 15: Block Diagram of a Method for Fabricating a Sensing Element

FIG. 15 illustrates a method for fabricating a directional microphone according to embodiments of the invention. The method shown in FIG. 15 may be used fabricate or manufacture any of the devices shown in the above Figures, among other devices. In various embodiments, some of the method elements shown may be performed concurrently, in a different order than shown, or may be omitted. Additional method elements may also be performed as desired. As shown, this method may operate as follows.

In 1502, a first layer may be thermally oxidized. In one embodiment, the first layer may be a silicon-on-insulator (SOI) wafer.

In 1504, a second layer may be deposited on a first side, or bottom, or back, of the first layer. In one embodiment, the second layer may be low-temperature oxide (LTO) layer.

In 1506, a third layer may be deposited on a second side, or top, or front, of the first layer. In one embodiment, the third layer may be a titanium layer. In such embodiments, e-beam evaporation may be used to deposit the titanium layer. Further, the titanium layer may be thermally-oxidized to transform the layer into a titanium-oxide layer which may serve as a lead diffusion barrier.

In 1508, one or more first, or bottom, electrodes may be disposed on the third layer. Disposing the one or more electrodes may include patterning one or more first locations of the one or more first electrodes and sputtering a conductive layer at the one or more locations. In one embodiment the conductive layer may be platinum.

In 1510, one or more piezoelectric layers may be deposited on the third layer and the one or more first electrodes. In one embodiment the one or more piezoelectric layers may be deposited using a sol-gel method. Additionally, in certain embodiments the one or more piezoelectric layers may be one or more lead-zirconate-titanate layers.

In 1512, one or more second, or top, electrodes may be disposed on the third layer. Disposing the one or more electrodes may include patterning one or more second locations of the one or more second electrodes and sputtering a conductive layer at the one or more locations. In one embodiment the conductive layer may be platinum.

In 1514, the first, second, third and one or more piezoelectric layers may be etched to form a diaphragm and a spring and piezoelectric sensing structure. In some embodiments, the etching may be realized using deep reactive ion etch (DRIE) and reactive ion etch (RIE) processes.

Figure 16:
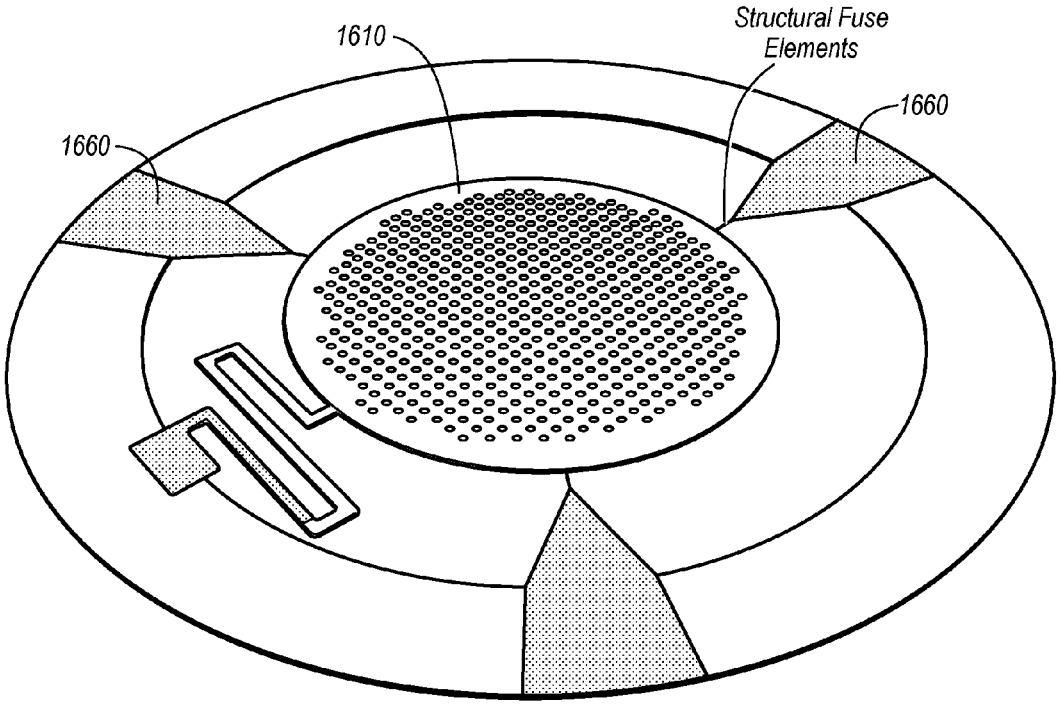
FIG. 16 illustrates an embodiment of a sensing structure with mechanical fuses used to support the structure during fabrication.

As illustrated in FIG. 16, an exemplary embodiment of a method of fabricating a sensing element for a directional microphone may include use of fuses for structural support during the fabrication process. Fuses 1660 may provide structural support for the highly compliant sensing element 1610 during the fabrication process. The "structural fuse elements" of fuses 1660 may keep the highly compliant sensing element 1610 in-plane during fabrication. Then, once packaged, a large impulsive current may be passed through the fuse to break it thereby mechanically freeing the structure.

Although the embodiments above have been described in considerable detail, numerous variations and modifications will become apparent to those skilled in the art once the above disclosure is fully appreciated. It is intended that the following claims be interpreted to embrace all such variations and modifications.

We claim:

1. A sensor system, comprising:

a deformable element comprising a material that is subject to deformation in response to pressure; and a plurality of sensing ports, wherein each respective sensing port of the plurality of sensing ports is in contact with a respective region of the deformable element, and wherein each respective sensing port is configured to sense a deformation of a corresponding respective region of the deformable element with respect to one or more axis of the deformable element and generate a signal in response thereto.

2. The sensor system of claim 1, wherein the plurality of signals are useable to determine spatial dependencies of the pressure with respect to one or more axis of the deformable element.

3. The sensor system of claim 2, wherein the spatial dependencies comprise spatial derivatives of the pressure with respect to one or more axis of the deformable element.

4. The sensor system of claim 1, wherein each sensing port comprises a pair of electrodes.

5. The sensor system of claim 1, wherein the plurality of sensing ports are a plurality of piezoelectric sensing ports.

6. The sensor system of claim 1, wherein the material that is subject to deformation is piezoelectric material.

7. The sensor system of claim 1, wherein the plurality of signals are useable by a functional unit coupled to the sensor system to determine spatial dependency of the pressure, wherein the spatial dependencies comprise spatial derivatives of the pressure with respect to one or more axis of the deformable element.

8. The sensor system of claim 1, wherein the deformable element is configured to limit the sensor system's resonant frequency below an audio spectrum or near a center of the audio spectrum.

9. An apparatus, comprising:

a deformable element comprising a material that is subject to deformation in response to external phenomenon; and a plurality of sensing ports, wherein each respective sensing port of the plurality of sensing ports is in contact with a respective region of the deformable element, and wherein each respective sensing port is configured to sense a deformation of a corresponding respective region of the deformable element and generate a signal in response thereto;

wherein the plurality of signals are useable by a functional unit coupled to the sensor system to determine spatial dependency of the external phenomenon, wherein the spatial dependencies comprise spatial derivatives of the external phenomenon with respect to one or more axis of the deformable element.

10. The apparatus of claim 9, wherein the external phenomenon is one of sound pressure or air pressure.

11. The apparatus of claim 9, wherein each sensing port comprises a pair of electrodes.

12. The apparatus of claim 9, wherein the plurality of sensing ports are a plurality of piezoelectric sensing ports.

13. The apparatus of claim 9, wherein the material that is subject to deformation is piezoelectric material.

14. A system, comprising:

a deformable element comprising a material that is subject to deformation in response to pressure; and a plurality of sensing ports, wherein each respective sensing port of the plurality of sensing ports is in contact with a respective region of the deformable element, and wherein each respective sensing port is configured to sense a deformation of a corresponding respective region of the deformable element and generate a signal in response thereto;

wherein the plurality of signals are useable to determine spatial gradients of the pressure with respect to one or more axis of the deformable element.

15. The system of claim 14, wherein the spatial gradients are further useable to determine second order spatial derivatives of the pressure with respect to one or more axis of the deformable element.

16. The system of claim 14, wherein each sensing port comprises a pair of electrodes.

17. The system of claim 14, wherein the plurality of sensing ports are a plurality of piezoelectric sensing ports.

18. The system of claim 14, wherein the material that is subject to deformation is piezoelectric material.

* * * * *